United States Patent [19]

Marshall et al.

[11] 4,279,599

[45] Jul. 21, 1981

[54] THERMAL TARGET AND WEAPON FIRE SIMULATOR FOR THERMAL SIGHTS

[75] Inventors: Albert H. Marshall, Orlando; George Derderian, Maitland, both of Fla.

[73] Assignee: The United States of America as represented by the Secretary of the Navy, Washington, D.C.

[21] Appl. No.: 71,142

[22] Filed: Aug. 30, 1979

[51] Int. Cl.[3] ..... F41G 3/26; F41J 1/00

[52] U.S. Cl. ..... 434/21; 273/348

[58] Field of Search ..... 35/25; 250/503; 273/348, 359, 360, 362, 365, 407, 409; 40/582, 612, 616; 434/11, 16, 21

[56] References Cited

U.S. PATENT DOCUMENTS

| | | | |
|---|---|---|---|
| 2,182,919 | 12/1939 | Hainsworth | 40/616 X |
| 2,933,317 | 4/1960 | Pittinger et al. | 273/362 |
| 2,972,053 | 2/1961 | Anderson | 250/503 |
| 3,339,293 | 9/1967 | Kuhlo et al. | 35/25 |
| 4,240,212 | 12/1980 | Marshall et al. | 434/11 |
| 4,253,670 | 3/1981 | Moulton et al. | 273/348 X |

FOREIGN PATENT DOCUMENTS

| | | | |
|---|---|---|---|
| 73871 | 10/1917 | Austria | 273/348 |
| 27681 | 3/1903 | Switzerland | 273/348 |

*Primary Examiner*—William H. Grieb

*Attorney, Agent, or Firm*—Richard S. Sciascia; Robert W. Adams

[57] ABSTRACT

An etched plate used to simulate an infrared target for trainees using simulated weapons. Selectively etching the plate in a variety of fashions successfully imitates the thermal signature of the simulated target. The simulated weapons are then "fired" at the plate and hits recorded. The plate may be electrically heated.

17 Claims, 3 Drawing Figures

THERMAL TARGET AND WEAPON FIRE SIMULATOR FOR THERMAL SIGHTS

BACKGROUND

Surveillance and military style weaponry expanded into the field of infrared detection and homing some time ago. Since then, numerous developments have occurred that have progressed the state of the art to a level of complexity and effectiveness which substantially assures reliable hardware. The effectiveness of the hardware for its intended purpose is now largely determined by the operator. Accordingly, thorough training is important.

For training, the more complete the simulation is of the actual operating environment, the more realistic and thorough the training procedure can be. If field conditions will be encountered in using the hardware, field-like conditions are desirable for training. If infrared surveillance is an element of operation, infrared sources that simulate the infrared signatures of the objects to be anticipated are required.

Many factors influence the selection of the various types of infrared sources that are available for use as target elements. The environment that it will be used in, outside or inside, whether the target is to be a permanent installation or portable, and whether the target is expendable or not, are among the factors that are considered. Prior art techniques available to the field are gorged with pyrotechnic approaches, which are followed at some distance by electrically heated structures. These techniques are for the most part consumable, and where it is intended that the target be preserved and used time and again, the techniques usually suggest an elaborate and complicated system.

For a programmed test range situation, a rugged, simple and effective target is needed. In the typical military application of such a situation, an operator controlled vehicle approaches the range, seeks out and detects targets with infrared sensitive equipment integral to the vehicle, and performs the "firing" process. Inasmuch as the range is to be used over and over, destructive "hits" cannot be permitted, so simulations abound. The more realistic the simulation, the better the training is.

The present invention is an achievement that provides a very suitable target for any training application in the infrared arena, particularly when the target is to be preserved. It is rugged, simple, and when once constructed has a longevity unequalled by most alternatives. Inasmuch as the invention can be devoid of all attachments, maintenance is minimal. It is particularly suitable to the type of range application that is described above, whether the range be scaled or full size, and it retains a high degree of reflectivity over the life of the structure, the significance of which will be described below.

DESCRIPTION OF THE PREFERRED EMBODIMENT

Figure 1:
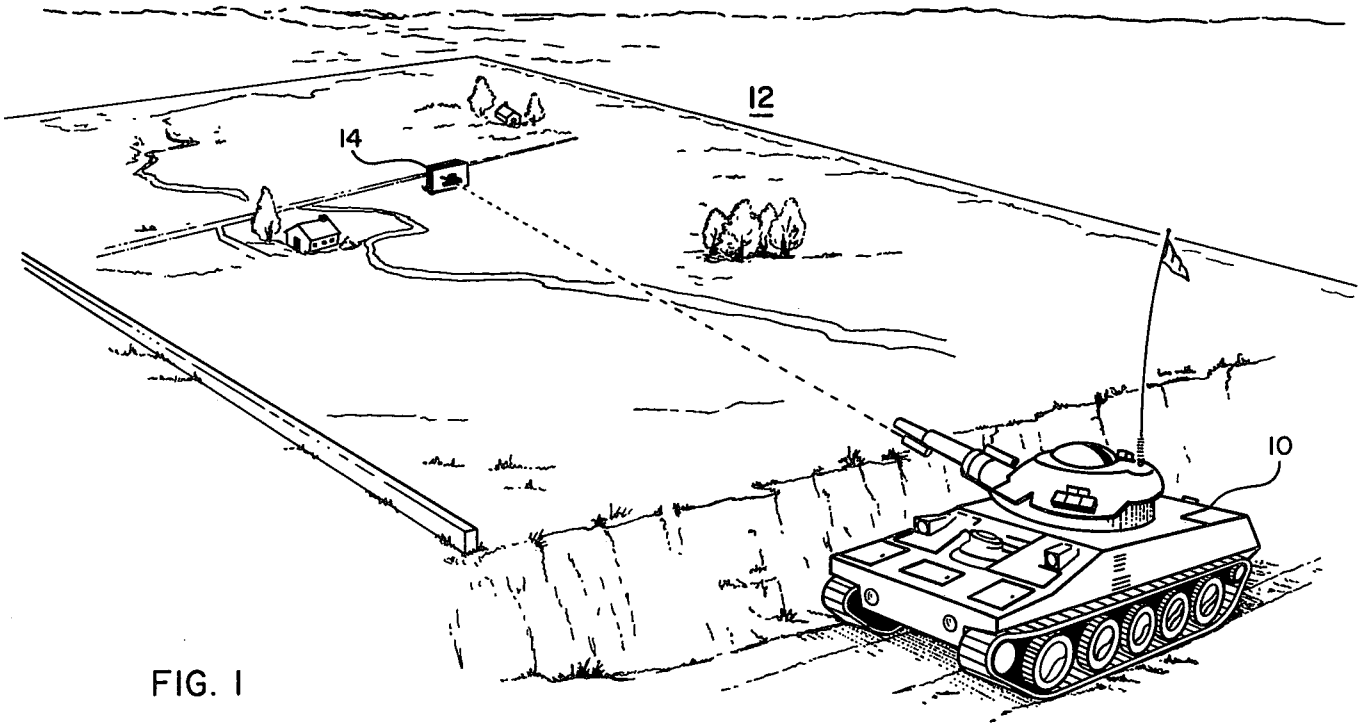
FIG. 1 is a pictorial of an application for the present invention.

An application of the present invention is shown in FIG. 1. Typically, a military range of the type shown is a permanent installation equipped for simulation training. Personnel in vehicle 10 are experiencing a realistic environment layout 12, which in the range shown is miniaturized to scale. They are learning to detect and respond to the apparent threat presented by target 14. Because the installation is intended to be used again and again, and in order to minimize costs, the weapon on vehicle 10 is not fired. Realistic firing is achieved by simulation techniques described by others in the art. Herein, the use of an infrared or laser source is recommended, as will be discussed below.

Figure 2:
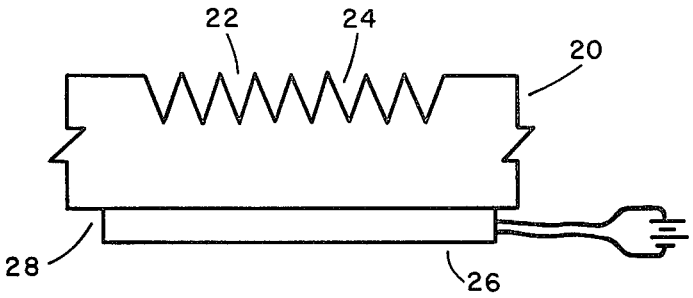
FIG. 2 is a cross-sectional view of an embodiment of the present invention.

An embodiment of the present invention is shown in FIG. 2. Metallic member 20 mostly likely a planar member is adapted by forming, working, or assembling to have a disturbed surface 22. The objective is to alter the emissivity of a portion or more of the surface of member 20. This can be accomplished in any appropriate fashion that selectively roughness or disturbs the member at its surface. Examples are machining or etching the surface. A surface that is to be formed could be texturized during the casting process. And a surface that is to be assembled in accordance with the invention could be the layering of plates that have a beveled edge, such as the assemblage of razor-like plates.

The preferred method of achieving the desired surface is by machining. Vertical grooves 24 may be cut into the metal at any angle of width, although experience has shown that efficient use of the surface will result if the grooves form approximately a fifteen degree wedge. Wedges up to thirty degrees will also be reasonably efficient.

Disturbing or disrupting the surface, or otherwise providing a textured appearance, increases emissivity. It is known that a darker surface is more emissive than a similar, but lighter colored, surface. Accordingly, a metal surface that is rendered darker in appearance becomes more emissive.

The present invention achieves a darker appearance, and also increases the area of the radiating surface. As FIG. 2 demonstrates, the surface of metallic member 20 is increased as one traces through the valleys and over the peaks of the grooves. The result is that the emissivity of the surface is increased where the surface has been disturbed.

The depth of grooves or scratchings 24 may be selected by trial and design, keeping in mind that a suitable arrangement would be obtained with a sawtooth shape of fifteen degree teeth. A trade-off between fewer deep, wide grooves, or more shallow, narrow grooves, will probably be a matter of choice since cuts of fifteen degrees have the approximate emissivity of a black body, regardless of the depth of the cuts. The objective is to increase emissivity to a desired level over that of the adjoining undisturbed surface, or the adjoining disturbed surface of different texture, and to that end trial testing of various arrangements to achieve the desired result might be productive. Markings made in an intersecting or criss-cross fashion may be tried.

FIG. 2 also shows a technique that will be used for most applications to increase the infrared emission from the target. Solar heating of metal member 20 will be sufficient to provide discernable emissions, and that may be enough for some uses. To increase the quantity of emitted energy to a level that would be sufficient for other or broader applications, and applications that can not rely on the availability of sunshine, additional heating is advised. To accomplish this, contact heater 26 is used. It may be in the form of a preheated member that is placed in contact with member 20, but more likely would be an electrical heater attached to rear surface 28 of member 20. The heater can be any of those that are known in the art, including Temsheet material and Eccocoat paint. The heater may be placed opposite only the disturbed portions of surface 22, or opposite undisturbed portions also, depending on the desired results. Likewise, heater 26 may be in the form of one or more heaters having the same or various heating capacities, strategically placed on surface 28 for the desired effect.

Figure 3:
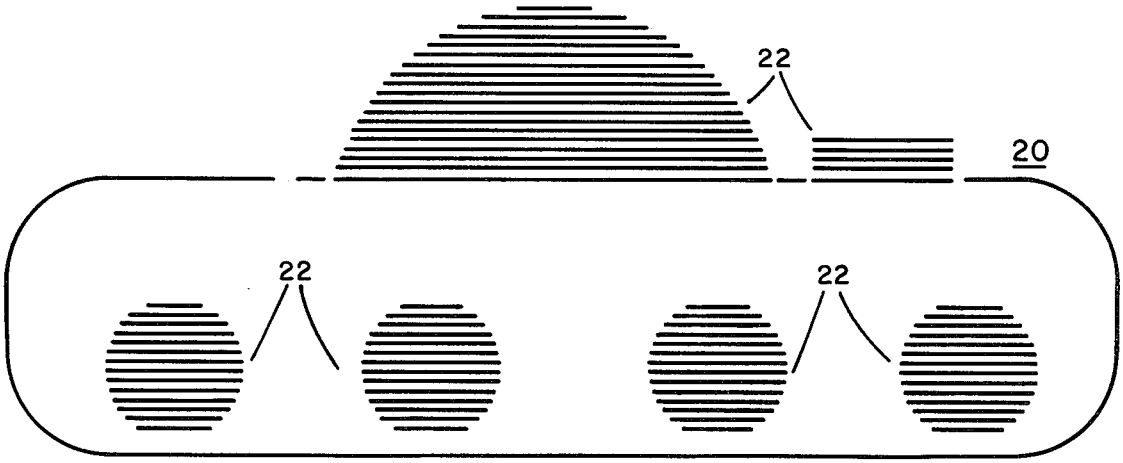
FIG. 3 is a plan view showing a use of the present invention.

FIG. 3 shows how the present invention may be used to provide an imitating thermal signature. For the application shown in FIG. 1, target 14 is to simulate the thermal signature of, for example, a tank. The target gives a general visual appearance of a tank silhouette, or of a detailed tank image; it makes little difference to the infrared portion of the invention. The portions of the target surface that correspond to the hotter portions of the tank are the ones that are rendered more emissive. Accomplish this by the various means disclosed or their equivalents. The contrast between portions is the characteristic that will identify the object. To that end the undisturbed portions of the frontal surface may be made less emissive, such as coating with a light colored material like white paint.

The original application of the present invention was in the military weapons training environment. Therein, as shown in FIG. 1, a range is typically used. The weapons conveyor, with the trainee present, moves into the training arena. Operational infrared sensors are used to detect the target created in accordance with the invention. The weapon is then "fired." Instead of a round, the weapon fires an infrared pulse. "Hits" are seen by the trainee as flashes on the target, which result when a pulse is reflected. The training is thereby effective to acquaint, or re-acquaint, the trainee with the equipment or sharpen his skills. Nothing is damaged, the weapon is not operationally fired and the target is not destroyed. As a result, the range may be used indefinitely.

The end result of the invention will be an infrared emitter than imitates the thermal signature of the object that is to be simulated, be it naturally occurring or man-made. Obviously, many modifications and variations of the present invention are possible in light of the above teachings. It is, therefore, to be understood that within the scope of the appended claims the invention may be practiced otherwise than as specifically described.

What is claimed is:

1. A target which simulates the thermal signature of a preselected object, comprising:

a planar member having a plurality of surface portions on a first surface of said member, selected to be distinguishable by their thermal emissivity, the first surface portion of said member having a substantially smooth surface and the second surface portion of said member having a relatively coarse texture rendered within the surface of said member, that correspond in relative size, placement and emissivity to the less thermally emissive and more thermally emissive areas, respectively, on the surface of said preselected object.

2. The invention of claim 1, wherein said member is of unitary construction.

3. The invention of claim 1, wherein said second portion has grooves that are in parallel.

4. The invention of claim 1, wherein said second portion has grooves that each form a wedge of between approximately fifteen degrees and thirty degrees.

5. The invention of claim 1, wherein said target further comprises a heater that is in contact with a second surface of said member.

6. The invention of claim 1, wherein said second surface portion is disturbed by machining.

7. The invention of claim 1, wherein said target is a casting and said second surface portion is disturbed by the cast during casting.

8. The invention of claim 1, wherein said second surface portion is disturbed by etching.

9. A training system for experiencing the use of infrared sensitive equipment in a weapon environment, comprising:

means for sensing infrared emissions;

simulated weapon means associated with said sensing means, operable by a trainee in response to said sensing means; and a plate member having a plurality of adjacent surfaces of preselected emissivities, at least one of said surfaces being an adaption within the surface of the material of said plate member to render said adapted surface more emissive and thereby imitate the relative thermal signature of a preselected object;

wherein said sensing means is used to detect said member.

10. The system of claim 9, wherein said plate member is of unitary construction.

11. The system of claim 10, wherein said adjacent surfaces on the frontal side of said plate member and said system further comprise a heater in contact with the rear side of said plate member, which is opposite said frontal side.

12. The system of claim 10, wherein said plate member is a casting and said adapted surfaces are adapted by the cast during casting.

13. The system of claim 9, wherein at least one of said adapted surfaces has grooves formed of between approximately fifteen degree and thirty degree wedges.

14. The system of claim 13, wherein said grooves are formed by machining.

15. The system of claim 9, wherein said adapted surfaces are etched surfaces.

16. A target that simulates an infrared source, for use in a target range environment to train personnel in the use of infrared-sensitive equipment, comprising a planar member having a substantially smooth surface, but with one or more areas in the substantially smooth surface predeterminedly disturbed by disruption of the surface texture in the surface of said planar member to increase the thermal emissivity of the area and provide a contrast between areas of the surface that is discernible with infrared sensitive apparatus, wherein said one or more disturbed areas are arranged together with other areas of said surface to compose an image of relative emissivities that imitates the thermal signature of a preselected object.

17. A practice target usable on a military training range to train personnel in the use of infrared sensitive weaponry, that has a relative thermal appearance composed of a plurality of various emissivities which together provide a simulated facsimile of the thermal signature of a preselected piece of operational military equipment, comprising:

a metal plate of homogeneous material, having as its major dimensional surfaces a front surface and a similar rear surface that are parallel and substantially flat, with said front surface positioned for exposure to said personnel in training, wherein said front surface includes one or more portions that have been preselectively chosen to correspond in placement to the more emissive areas of the thermal signature of said equipment, and said surface portions have been disturbed to provide a texture in the surface of said material that increases the thermal emissivity of said portions to imitate the relative thermal emissivity of the correspondingly more emissive areas, as distinguished from the less emissive areas, of said equipment.

* * * * *